United States Patent [19]

Masuda et al.

[11] Patent Number: 4,794,893

[45] Date of Patent: Jan. 3, 1989

[54] ENGINE VALVE DRIVING APPARATUS

[75] Inventors: Shunji Masuda; Tatsuya Uesugi; Hiroyuki Oda, all of Hiroshima, Japan

[73] Assignee: Mazda Motor Corporation, Hiroshima, Japan

[21] Appl. No.: 82,621

[22] Filed: Aug. 7, 1987

[30] Foreign Application Priority Data

Aug. 8, 1986 [JP] Japan ..... 61-186246

[51] Int. Cl.[4] ..... F01L 1/08; F01L 1/24; F01L 1/34

[52] U.S. Cl. ..... 123/90.17; 123/198 F; 123/90.55

[58] Field of Search ..... 123/90.17, 90.18, 90.48, 123/90.5, 90.55, 90.6, 198 F

[56] References Cited

U.S. PATENT DOCUMENTS

| | | | |
|---|---|---|---|
| 4,388,897 | 6/1983 | Rosa | 123/90.17 |
| 4,401,069 | 8/1983 | Foley | 123/198 F |
| 4,494,506 | 1/1985 | Hayama et al. | 123/90.18 X |
| 4,498,352 | 2/1985 | Hedelin | 123/90.17 X |
| 4,522,085 | 6/1985 | Kane | 123/90.17 X |

FOREIGN PATENT DOCUMENTS

| | | | |
|---|---|---|---|
| 2950656 | 6/1981 | Fed. Rep. of Germany | 123/90.17 |
| 0410020 | 5/1910 | France | 123/90.17 |
| 0054616 | 4/1980 | Japan | 123/90.17 |
| 0091317 | 5/1983 | Japan . | |
| 0155515 | 9/1984 | Japan . | |

*Primary Examiner*—Willis R. Wolfe

*Attorney, Agent, or Firm*—Fleit, Jacobson, Cohn & Price

[57] ABSTRACT

Engine valve driving apparatus including a camshaft rotatable with a crankshaft of the engine with a movable cam member supported in sliding fit by the camshaft for axial movement but prevented from any rotation relative to the camshaft. An engine valve is driven by the movable cam member, and a hydraulic system axially shifts the movable cam member between an operative position where the movable cam member is brought into cooperation with the engine valve and an inoperative position where the movable cam member is completely out of cooperation with the engine valve. The hydraulic system causes the shifting movement of the movable cam member according to engine operating conditions so that the engine valve is driven at different speeds or different timings.

11 Claims, 5 Drawing Sheets

ENGINE VALVE DRIVING APPARATUS

BACKGROUND OF THE INVENTION

The present invention relates to an engine valve driving apparatus, and more particularly to an engine valve driving apparatus by which an engine valve is controlled to work according to engine operating conditions.

In the field of internal combustion engines, engine valve driving apparatus are generally well known by which an engine valve is controlled to work in cooperation with a valve driving cam according to engine operating conditions. One such engine valve driving apparatus as described in Japanese Patent Unexamined Publication No. 59-155,515 entitled "Valve Closing Device", laid open Aug. 4, 1984, relates to a device comprised of a camshaft, a valve driving cam rotatably supported by the camshaft, and a plunger disposed in the camshaft which causes the interruption of relative rotation between the camshaft and the valve driving cam which is controlled to move radially by a hydraulic system according to engine operating conditions.

In the device taught by the above-mentioned Japanese Patent Unexamined Publication, the plunger is usually forced by a biasing spring to partially radially protrude from the camshaft and to enter an engaging bore formed in the valve driving cam when no oil pressure is exerted on the plunger, interconnecting the camshaft and the valve driving cam. Due to this rigid interconnection, the valve driving cam and camshaft can rotate as an integral whole, so as to drive suction and exhaust valves to open and close in a predetermined timing. If oil pressure is exerted on the plunger, then the plunger retracts into the camshaft against the biasing spring to dissolve or interrupt the interconnection between the camshaft and the valve driving cam, permitting the valve driving cam to rotate about and relative to the camshaft. That is, the camshaft runs idle with the valve driving cam rendered inoperative.

There is another type of engine valve driving apparatus which is taught by Japanese Patent Unexamined Publication No. 58-91,317 entitled "Variable Timing Mechanism", laid open May 31, 1983. This mechanism has at least two valve driving cams which are selectively brought into operational engagement with an engine valve according to engine operating conditions; namely, high speed and low speed engine operating conditions. These valve driving cams are fixedly mounted side-by-side on a hollow cylindrical member with an annular hub provided at one end thereof. The hollow cylindrical member is supported in sliding fit by the camshaft for axial movement. For causing the axial movement of the hollow cylindrical member, there is an axially extending shifting shaft with a fork fixed thereto and engaged by the annular hub of the hollow cylindrical member. By moving the shifting shaft axially, the two cams are interchangeably brought into cooperation with the engine valve to drive it in different timings according to engine operating conditions. such an engine valve driving apparatus as described above is widely applicable to engines for the purpose of effecting various engine controls; for instance, changing timings in which the engine valve opens and closes according to engine operating conditions, stopping valve motion under a specific engine operating condition, or the like.

However, the device taught by the above-mentioned Japanese Patent Unexamined Publication No. 59-155,515 is structurally unfavorable in view of strength because of the fact that what is subjected to a reaction caused as the result of an action of he engine valve is only the plunger when the valve driving cam rotates integrally with the camshaft in one body. In this respect, the device taught by the above-mentioned Japanese Patent Unexamined Publication No. 58-91,317 is more or less advantageous on comparison with the former one not only because the valve driving cam is supported over the whole width thereof but also because a plurality of axially extending splines by which the valve driving cam and camshaft are coupled to each other support reaction froce from the engine valve, individually. Although having such structural advantages, nevertheless, the provision of the shifting shaft and fork unavoidably makes the device not only large but also complex.

OBJECTS OF THE INVENTION

It is, therefore, an object of the present invention to provide an engine valve driving apparatus which is compact and has a sufficient structural strength.

It is another object of the present invention to provide an engine valve driving apparatus which has a greatly improved durability and reliability.

SUMMARY OF THE INVENTION

In accordance with the present invention, the engine valve driving apparatus (which is hereinafter referred to as the valve driving apparatus) comprises a camshaft rotatable in synchronism with rotation of a crankshaft of the engine; a cam member supported in sliding fit with the camshaft for axial movement, but prevented from any rotation relative to the camshaft; an engine valve driven by the cam member; means for axially shifting the cam member between a first operative position wherein the cam member drives the engine valve and a second inoperative position wherein the cam member is completely out of cooperation with the engine valve; and means for controlling the shifting means according to engine operating conditions.

According to a feature of a preferred embodiment of the present invention, the cam member and the camshaft are separately prepared and then assembled as one body by means of splines, for example. Alternatively, the camshaft is shaped with a generally rectangular cross section, and is fitted into a complementary shaped groove of the cam member for coupling. In consequence, the cam member and the camshaft can rotate as one body, and can be allowed to move axially relative to each other and prevented from any relative rotation. the shifting means which is provided to cause the relative axial movement between the cam member and the camshaft, is comprised of plungers each of which is slidably disposed in an oil passage formed in the camshaft and actuated by a hydraulic system to shift the cam member.

BRIEF DESCRIPTION OF THE DRAWINGS

The above and other objects and features of novelty of the present invention will be evident to those skilled in the art from the following description taken in conjunction with the accompanying drawings in which like parts are denoted by corresponding reference numerals and symbols throughout several views in order to avoid the repetition of description and wherein.

DETAILED DESCRIPTION OF THE INVENTION

Figure 1:
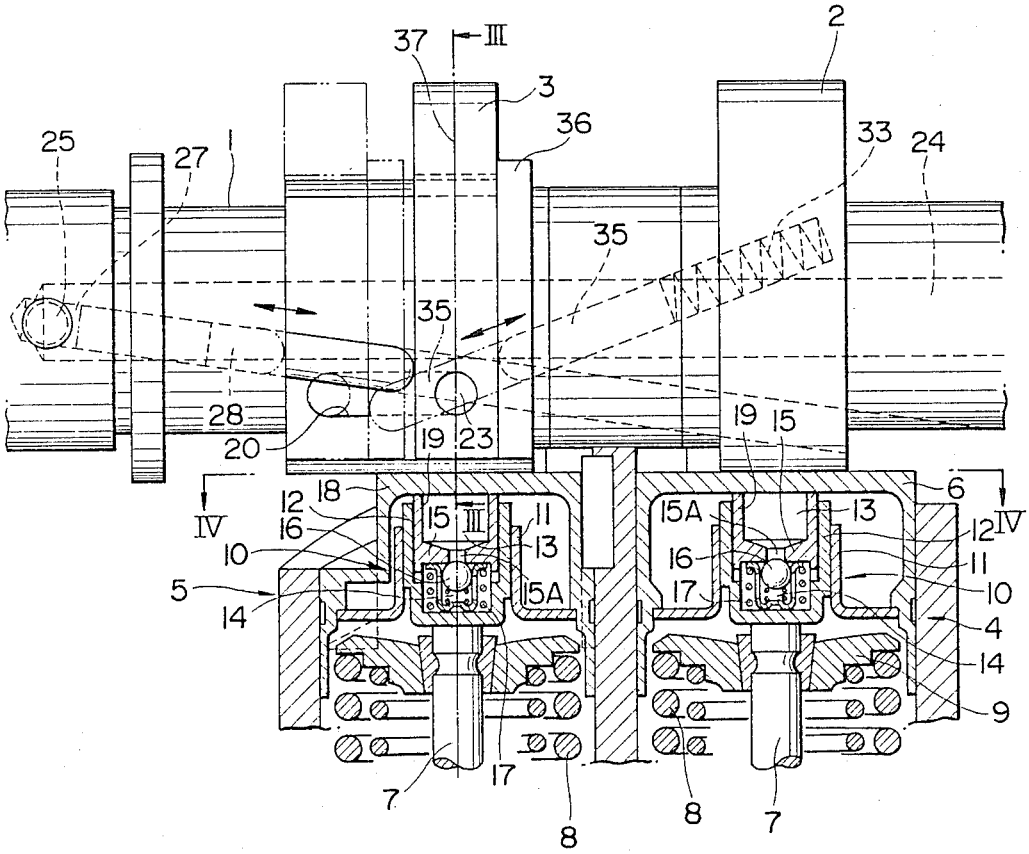
FIG. 1 is a view, partially in cross-section, of the valve driving apparatus according to a preferred embodiment of the present invention.

Because internal combustion engines are well known to those skilled in the art, the present description will be directed in particular to elements forming part, or cooperating more directly with, the present invention. Engine elements not specifically shown or described herein being understood to be selectable from those known in the prior art.

Referring now to the drawings, in particular to FIGS. 1 through 4, shown therein is a preferred embodiment of the valve driving apparatus for use with an internal combustion engine and is comprised of a cam driven engine valve. The apparatus has a camshaft 1 rotatable in synchronism with the rotation of an engine crankshaft, not shown, but well known per se in the art. This camshaft 1 is provided with two cam members 2 and 3, one being fixedly attached thereto and the other being supported in sliding fit for axial movement. The movable cam member 3 is adapted not to rotate relative to the camshaft 1. Positioned corresponding to the respective cam members 2 and 3 are engine valves 4 and 5 each of which is provided with a tappet 6, 18 is a valve stem 7 having a valve head open to a combustion chamber at its lower end and a spring retainer 9 fixed thereto near its top end for a coil spring 8.

Between the tappet 6, 18 and the valve stem 7 is a hydraulic lash adjuster (which is hereinafter abbreviated to a HLA) 10 for automatically adjusting a gap possibly induced between the top of the tappet 6, 18 and the outer periphery of the cam members 2, 3. This HLA 10 has a substantially cylindrical plunger 12 supported in sliding fit by an open ended guide cylinder 11 fixed to the tappet 6, 18 for retractable movement. The plunger 12 telescopically water-tightly supports therein an inner cylindrical plunger 19 having a partition wall 15 which divides the inside of the plunger 12 into two chambers; namely an upper oil chamber 13 and a lower oil chamber 14. These upper and lower oil chambers 13 and 14 are communicated with each other by means of an oil passage 15*a* defined by a hole formed in the partition wall 15. In the lower oil chamber 14, there is a ball 16 biased upwards by a coil spring 17 to stop up the oil passage 15*a*. The plunger 12 thus structured cam permit an oil flow from the upper oil chamber 13 into the lower oil chamber 14 but blocks the reversed oil flow. In consequence, if there is a gap produced between the top of the valve stem 7 and the bottom of the plunger 12, the pressure in the upper oil chamber 13 gets above that in the lower oil chamber 14, producing a pressure difference therebetween. This pressure difference forces down the ball 16 against the coil spring 17 to open the oil passage 15*a*, causing an oil flow from the upper oil chamber 13 into the lower oil chamber 14 through the oil passage 15*a*. As a result, the pressure applied in the lower oil chamber 14 gradually increases, forcing down the plunger 12 to bring it into abutment against the valve stem 7. In such a way as described above, any gap induced between the valve stem 7 and the plunger 12 is automatically removed.

It is noted that although the engine valve 5 is substantially the same in structure and function as the engine valve 4, nevertheless, the tappet 18 of the engine valve 5 is partially cut away. Due to the engine valve 5 having a part cut away, an undesirable interference between the movable cam member 3 and the engine valve 5 is avoided. Moreover, because the moving length of the movable cam member 3 required to move out of the tappet 18 can be shortened, the engine valve driving apparatus can be made compact.

Figure 3:
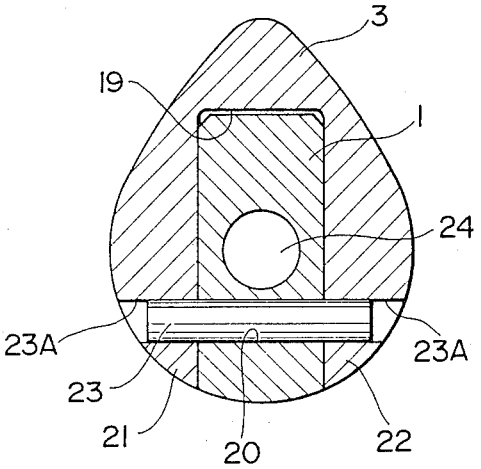
FIG. 3 is a sectional view taken along line III—III of FIG. 1 showing a coupling mechanism between a cam member and a camshaft.
Figure 4:
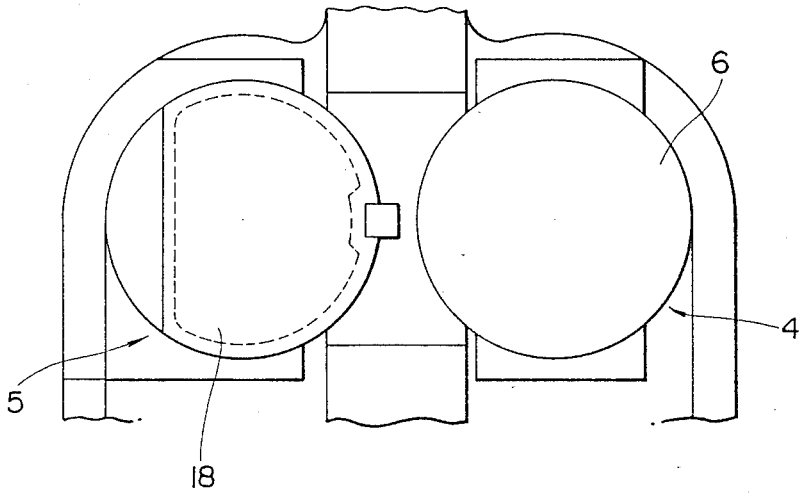
FIG. 4 is a plan view taken along line IV—IV of FIG. 1 showing engine valves.

Reference is now had to FIG. 3 showing the movable cam member 3 in cross section. The movable cam member 3 has a generally U-shaped sectional or teardrop configuration forming a groove 19 into which is fitted part of the camshaft 1 having a complementarily shaped rectangular sectional configuration. As is seen in FIG. 1, the fitting part of the camshaft 1 is formed with a slot 20 laterally penetrating and exially extending therein. In the movable cam member 3 at its leg portions 21 and 22 there is also formed bores 23A penetrating therethrough. Into these bores 34A, a knock-pin 23 is fixedly inserted passing through the slot 20 of the camshaft 1 to couple the movable cam member 3 to the camshaft 1. Due to this pin-slot coupling, the movable cam member 3 is restricted to move axially between the axial extremities of the slot 20 formed in the camshaft 1.

Figure 5:
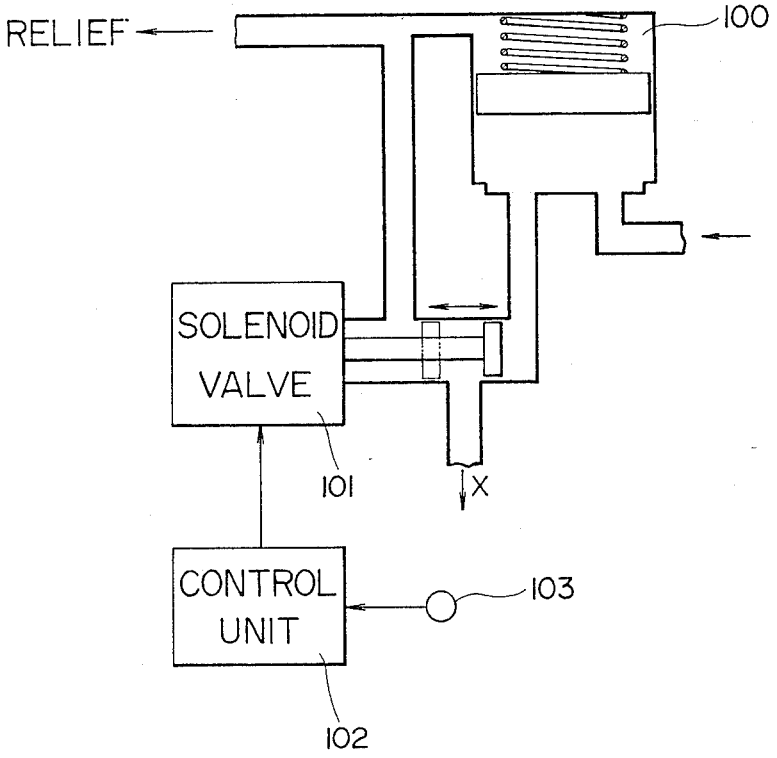
FIG. 5 is a block diagram illustrating a hydraulic system.

The valve driving apparatus of this embodiment operates in cooperation with a hydralic system which controls the axial movement of the movable cam member 3. For this control of axial cam movement, there is formed in the camshaft 1 an axially extending oil passage 24 and a pair of cylindrical oil passages 26 and 27 extending substantially axially and parallel to the oil passage 24. The oil passages 26 and 27 are communicated with the oil passage 24 through a transverse oil passage 25. Through an inlet indicated by an arrow X, pressurized oil is supplied into the oil passage 24 with the aid of the hydraulic system shown in FIG. 5. This hydraulic system, which is well known per se in the art, comprises an accumulator 100, a solenoid valve 101 for switching over the direction of oil flow, and a control unit 102 for providing a control signal according to engine operating conditions by which the solenoid valve 101 is actuated. Denoted at 103 is a revolution counter operationally coupled to the control unit 102.

In each oil passage 26, 27, there is a plunger 28, 29 with its top end rounded which is airtightly disposed in sliding fit and in contact with one side surface of the movable cam member 3 at the rounded end. As is apparent from FIG. 1, the extension of the center line of the plunger 28, 29 is directed slightly away upwards from the center line of the knock-pin 23.

There are also formed in the camshaft 1 a pair of substantially axially elongated bores 30 and 31 located on the side opposite to the side where the pair of oil passages 26 and 27 are formed, symmetrically with respect to the center line of the knock-pin 23. In each bore 30, 31, there is a plunger 34, 35 with its top end rounded which is disposed in sliding fit and abuts the opposite side surface of the movable cam member 3 at its rounded end.

Figure 2:
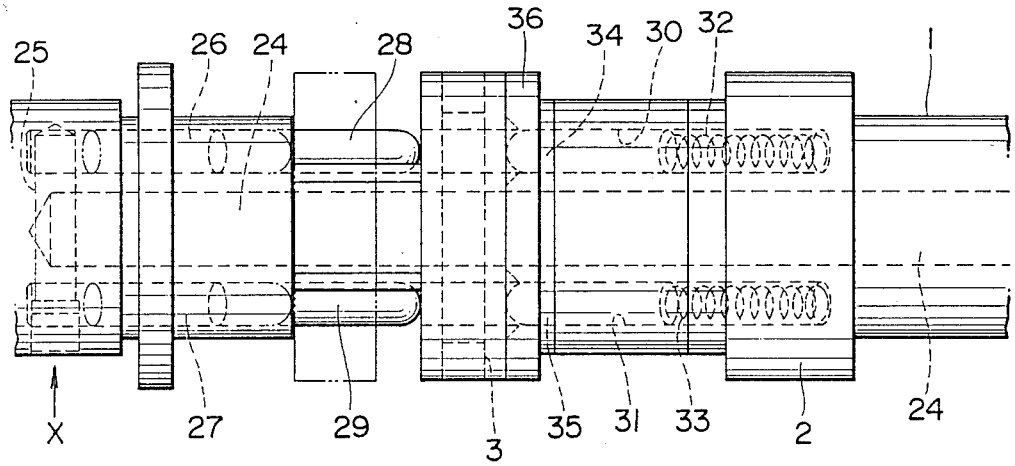
FIG. 2 is a plan view of the valve driving apparatus of FIG. 1, with certain parts omitted.

In operation of the valve driving apparatus described above, when oil pressure is conducted into the oil passage 24 and a sufficient pressure is built in the oil passages 26 and 27, the plungers 28 and 29 are forced to press against the side surface of the movable cam member 3, shifting it toward the right hand side as viewed in FIGS. 1 and 2. In consequence, the movable cam member 3 is placed in the operative position above the engine valve 5 and brought into the operative position where the movable cam member is aligned with a line of action of the engine valve 5, thereby being enabled to drive the engine valve 5 through the rotation of the camshaft 1.

On the other hand, if the oil pressure is relieved from the oil passage 24 to remove the pressure in the oil passages 26 and 27, the plungers 34 and 35 are then pushed back by the biased coil springs 32 and 33 to press and shift the movable cam member 3 toward the left hand side as viewed in FIGS. 1 and 2, bringing the movable cam member 3 into the inoperative position where the movable cam member 3, is completely out of cooperation with the engine valve 5. Accordingly, notwithstanding the camshaft 1 and the movable cam member 3 rotating in one body, the engine valve 5 is by no means driven and is rendered disabled or inactive.

According to the above described structure of the valve driving apparatus of this embodiment, because the movable cam member 3 is coupled to the camshaft 1 throughout the whole width thereof, not only a sufficient coupling strength but also a sufficient structural strength can be realized in the valve driving apparatus. In addition to this strength feature, the provision of a part of the hydraulic system, namely the oil passages, in the camshaft 1, makes it possible to reduce the dimensions of the apparatus and to arrange it compactly.

A problem may arise with the engine valve 5 in that the tappet 18 may possibly protrude slightly upwards too much when the movable cam member 3 is shifted to the inoperative position. A protruding engine valve would tend to hinder a smooth and solid reengagement of the movable cam member 3 with the engine valve 5. This problem results from the provision of the HLA 10 in which the plunger 12 is forced downwards, that is, to push up the tappet 18. Although usihg the HLA 10 in this embodiment, no undesirable protrusion of the engine valve 5 occurs because of the provision of a circular cam extension. Specifically, the movable cam member 3 has an axially extending circular cam extension 36 formed integrally therewith and having the same diameter as of the base circle thereof. As the circular cam extension 36 itself is always maintained in engagement with the engine valve 5 even though the movable cam member 3 gets out of cooperation with the engine valve 5, such protrusion of the engine valve 5 is by no means caused by the HLA 10. Due to the provision of the circular cam extension 36, the valve driving apparatus of this invention can perform valve driving controls while making use of the advantageous effects of the HLA 10.

Figure 6:
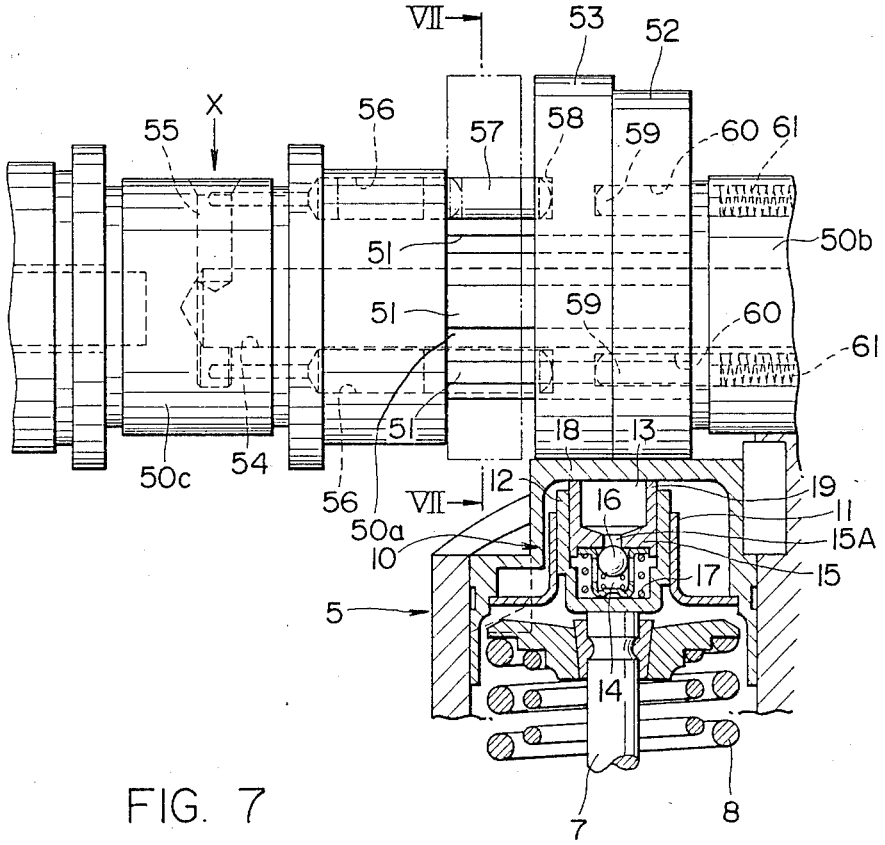
FIG. 6 is a view, partially in cross-section, of the valve driving apparatus according to an alternate preferred embodiment of the present invention.

Reference is now had to FIG. 6 showing the valve driving apparatus of another preferred embodiment of the present invention. In this embodiment, a camshaft 50 itself is structured by assembling a main shaft 50*a* and journal members 50*b* and 50*c* in any known manner such as a spline-coupling, and then fixed together by knock-pins (not shown). On this camshaft 50, there are mounted two cam members 52 and 53 for driving a single engine valve 5 at different driving conditions, namely a low speed and a high speed engine operating condition. One of the cam members, namely the cam member 52 for low speed driving, is coupled through splines 51 and rigidly fixed to the main camshaft 50*a;* but the other, namely the cam member 53 for high speed driving, is supported by the main camshaft 50a for axial movement.

Figure 7:
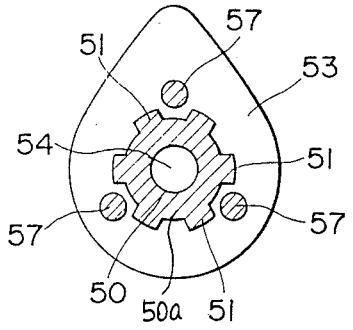
FIG. 7 is a sectional view taken along line VII—VII of FIG. 6 showing a coupling mechanism between a cam member and a camshaft.

The movable cam member 53, as is shown in detail in FIG. 7, is also spline-coupled to, but axially movable with respect to, the camshaft 50. It should be noted that the movable cam member 53 for high speed engine operation has a cam lobe lifted higher than the fixed cam member 52 for low speed engine operation. For causing an axial movement of the movable cam member 53, there is provided, in the camshaft 50, an axially extending oil passage 54 which is communicated with three oil passages 56 parallel to each other by means of radially extending passages 55. In each oil passage 56 is a plunger 57 airtightly disposed in sliding fit and contacting at one end with a recess 58 formed in one side surface of the movable cam member 53. Abutting against the other side surface of the movable cam member 53 are three plungers 59 disposed in sliding fit in elongated bores 60 which axially extend passing through the fixed cam member 52. Each plunger 59 is forced by a biasing coil spring 61 in the bore 60 in a direction opposite to the direction of action of the respective lunger 57.

According to the valve driving apparatus of this embodiment, when oil pressure is conducted into the oil passage 54 and a sufficient pressure is built within the oil passages 56, the plungers 57 are forced to press against the side surface of the movable cam member 53, shifting it in the axial direction to the right hand side as viewed in FIG. 6. In consequence, the movable cam member 53 is placed in the operative position above the engine valve 5 and brought into engagement with the tappet 18 of the engine valve 5, thereby being enabled to drive the engine valve 5 through the rotation of the camshaft 50. On the other hand, if the oil pressure is relieved from the oil passage 54 to remove the pressure in the oil passage 56, the plungers 57 are then unrestricted to move. Consequently, the biased springs 61 push the plungers 59 to shift back the movable cam member 43 to the left hand side as viewed in FIG. 6, bringing the movable cam member 53 into the inoperative position where the movable cam member 53 is completely out of cooperation with the tappet 18 of the engine valve 5. As an inevitable consequence, the fixed cam member 52 having a low lift of cam lobe is rendered cooperative with the tappet 18 of the engine valve 5 for low speed engine operation.

As is described above, by controlling pressure exerted on the plungers 57 according to engine operating conditions, the engine valve 5 can be driven to open and close in different timings.

In both embodiments described above, a sufficient coupling and structural strength can be realized in the valve driving apparatus. Additionally, the valve driving apparatus can be reduced in dimensions and arranged compactly.

The invention has been described with particular reference to preferred illustrative embodiments thereof, but it will be understood to those skilled in the art that variations and modifications can be effected within the scope of the invention.

What is claimed:

1. An engine valve driving apparatus for an internal combustion engine having a cam driven engine valve, said apparatus comprising: a camshaft rotatable in synchronism with rotation of a crankshaft of an engine; a movable cam member supported by said camshaft for axial movement and prevented from turning relative to said camshaft; shifting means slidably received in said camshaft for substantially axial movement for axially shifting said movable cam member between an operative position wherein said cam member is cooperative with a member of said engine valve so as to cause an operation of said engine valve and an inoperative position wherein said cam member is out of cooperation with said member; and hydraulic means for causing said substantially axial movement of said shifting means according to an engine operating condition, wherein said shifting means comprises first and second plungers disposed within said camshaft for sliding movement, said first plunger being forced by means of a spring member to shift said movable cam member to said inoperative position and said second plunger being caused by said hydraulic means to shift said movable cam member to said operative position against the spring force exerted on said first plunger.

2. An engine valve driving apparatus for an internal combustion engine having a cam driven engine valve, said apparatus comprising: a camshaft rotatable in synchronism with rotation of a crankshaft of an engine; a movable cam member supported by said camshaft for axial movement and prevented from turning relative to said camshaft; shifting means slidably received in said camshaft for substantially axial movement for axially shifting said movable cam member between an operative position wherein said cam member is cooperative with a member of said engine valve so as to cause an operation of said engine valve and an inoperative position where in said cam member is out of cooperation with said member; and hydraulic means for causing said substantially axial movement of said shifting means according to an engine operating condition, wherein said valve member is a tappet supported by said engine valve for reciprocal movement, said tappet having a cut-away portion for avoiding an interference between said movable cam member in said inoperative position and said tappet itself.

3. An engine valve driving apparatus for an internal combustion engine having a cam driven engine valve, said apparatus comprising: a camshaft rotatable in synchronism with rotation of a crankshaft of an engine; a movable cam member supported by said camshaft for axial movement and prevented from turning relative to said camshaft; shifting means slidably received in said camshaft for substantially axial movement for axially shifting said movable cam member between an operative position wherein said cam member is cooperative with a member of said engine valve so as to cause an operation of said engine valve and an in operative position wherein said cam member is out of cooperation with said member; and hydraulic means for causing said substantially axial movement of said shifting means according to an engine operating condition, wherein said movable cam member is coupled to said camshaft by means of a pin-slot engagement in which a knock-pin transversely extends from one side to the other side of said movable cam member passing through an axially extending slot of said camshaft.

4. An engine valve driving apparatus for an internal combustion engine having a cam driven engine valve, said apparatus comprising: a camshaft rotatable in synchronism with rotation of a crankshaft of an engine; a movable cam member supported by said camshaft for axial movement and prevented from turning relative to said camshaft; shifting means slidably received in said camshaft for substantially axial movement for axially shifting said movable cam member between an operative position wherein said cam member is cooperative with a member of said engine valve so as to cause an operation of said engine valve and an inoperative position wherein said cam member is out of cooperation with said member; and hydraulic means for causing said substantially axial movement of said shifting means according to an engine operating condition, wherein said valve member is a tappet which is supported by said engine valve for reciprocal movement and provided with a hydraulic lash adjuster between said tappet and a valve stem of said engine valve and said movable cam member is formed with a circular cam axial extension which has a diameter equal to that of a base circle of said movable cam member and is maintained in contact with said tappet when said movable cam member is shifted to the inoperative position.

5. An engine valve driving apparatus for an internal combustion engine having a cam driven engine valve, said apparatus comprising: a camshaft rotatable in synchronism with rotation of a crankshaft of an engine; a movable cam member supported by said camshaft for axial movement and prevented from turning relative to said camshaft; shifting means slidably received in said camshaft for substantially axial movement for axially shifting said movable cam member between an operative position wherein said movable cam member is cooperative with a tappet in association with a valve stem of said engine valve and inoperative position wherein said movable cam member is out of cooperation with said tappet; and hydraulic means for causing said substantially axial movement of said shifting means according to an engine operating condition, thereby enabling and disabling said engine valve to open and close.

6. An engine valve driving apparatus for an internal combustion engine having a cam driven engine valve, said apparatus comprising: a camshaft rotatable in synchronism with rotation of a crankshaft of an engine; a movable cam member supported by said camshaft for axial movement and prevented from turning relative to said camshaft; shifting means slidably received in said camshaft for substantially axial movement for axially shifting said movable cam member between an operative position wherein said cam member is cooperative with a member of said engine valve valve so as to cause an operation of said engine valve and an inoperative position wherein said cam member is out of cooperation with said member; and hydraulic means for causing said substantially axial movement of said shifting means according to an engine operating condition.

7. An engine valve driving apparatus as defined in claim 6, further comprising a cam member fixedly supported by said camshaft which is brought into cooperation with said engine valve when said movable cam member is shifted to its inoperative position.

8. An engine valve driving apparatus for an internal combustion engine having a cam driven engine valve, said apparatus comprising:

a camshaft rotatable in synchronism with rotation of a crankshaft of an engine;

a movable cam member having a lift lobe supported by said camshaft for axial movement;

a fixed cam member supported by said camshaft and having a lift lobe lower than said lift lobe of said movable cam member;

shifting means for axially shifting said movable cam member between an operative position wherein said movable cam member is cooperative with a tappet connected to a valve stem of said engine valve and an inoperative position wherein said movable cam member is out of cooperation with said tappet; and means responsive to an operating condition of said engine to cause said movable cam member to shift to the inoperative position so that said tappet is actuated only by said fixed cam member.

9. An engine valve driving apparatus as defined in claim 8, wherein said shifting means comprises first and second plungers disposed within said camshaft for sliding movement, said first plunger being forced by means of a spring member to shift said movable cam member to said inoperative position and said second plunger being caused by said hydraulic means to shift said movable cam member to said operative position against the spring force exerted on said first plunger.

10. An engine valve driving apparatus as defined in claim 6, wherein said tappet is supported by said engine valve for reciprocal movement and has a cut-away portion for avoiding an interference between said movable cam member in said inoperative position and said tappet itself.

11. An engine valve driving apparatus as defined in claim 8, wherein said movable cam movable cam member is coupled to said camshaft by means of a spline.

* * * * *